United States Patent [19]

Meyer

[11] 4,386,751

[45] Jun. 7, 1983

[54] SWITCH POINT GUARD

[75] Inventor: J. Joe Meyer, Williamsburg, Ind.

[73] Assignee: Western-Cullen-Hayes, Inc., Chicago, Ill.

[21] Appl. No.: 251,467

[22] Filed: Apr. 6, 1981

[51] Int. Cl.[3] ..... E01B 5/18; E01B 7/02; E01B 7/20

[52] U.S. Cl. ..... 246/441; 238/22; 238/23; 246/456

[58] Field of Search ..... 238/22, 23; 246/441, 246/456

[56] References Cited

U.S. PATENT DOCUMENTS

| | | | |
|---|---|---|---|
| 764,108 | 7/1904 | Brewer | 246/441 |
| 853,254 | 5/1907 | Miller | 238/23 |
| 1,382,868 | 6/1921 | Strong | 246/456 |
| 1,586,734 | 7/1926 | Fleming | 246/441 |
| 1,591,277 | 7/1926 | Brown et al. | 246/441 |
| 1,597,255 | 8/1926 | Weedon | 246/441 X |
| 1,628,882 | 5/1927 | Hoffman et al. | 246/441 |
| 2,597,697 | 5/1952 | Asselin | 238/23 X |

*Primary Examiner*—Robert B. Reeves
*Assistant Examiner*—Howard Beltran
*Attorney, Agent, or Firm*—Charles F. Pigott, Jr.

[57] ABSTRACT

A switch point guard for railroad track having a guard or deflector rail positioned to prevent flanges of railroad wheels from striking the switch point. The guard rail is carried on support members for rigid retention in a fixed, predetermined position relative to the track. By this invention the guard rail is carried by horizontally positioned guard rail plate means attached to the side of the guard rail. Apertures are defined in the rail plate means with chock plates positioned in the apertures. The chock plates each define an aperture off center in the direction perpendicular to the guard rail, with the support members defining attached projecting members occupying the off-center apertures. Accordingly, peripheral edges of the chock plates occupy different positions depending upon which side of the chock plates faces toward the rail track. Thus the predetermined position of the guard rail can be varied.

10 Claims, 7 Drawing Figures

SWITCH POINT GUARD

BACKGROUND OF THE INVENTION

The switch of a railroad track includes a switching rail which terminates in a sharply pointed end, adapted to be placed against another rail in the switch system. The flanged railroad wheel is guided off the last mentioned rail, across the pointed end of the switching rail, and then along the switching rail, to direct the railroad wheels along another track as may be desired.

As a continuing problem in the maintenance of switches, the pointed end of the switching rail is relatively fragile, and can be bent or blunted by impact with the flange of the wheel of a railroad car. This can cause subsequent switch failure and even derailment. Accordingly, it has been conventional to provide switch point guards, which are auxiliary rails positioned to press against the edge of the wheel opposed to the flange of the rail wheel, and positioned so that the flange of the rail wheel is laterally spaced from the switch point to prevent its impacting against the thin end of the switching rail.

For example, certain switch point guards recommended by the American Railway Engineering Association include a guard rail for the purpose of controlling the lateral position of rail wheels as they pass by the switch point. The guard rail is firmly secured to a base which, in turn, is spiked into the ties of the railroad track. A disadvantage with this, however, lies in the fact that the guard rails tend to wear with use, since they catch the railroad car wheels and force them into a position where the wheel flanges will not damage the switching rail. Accordingly, as the guard rails wear and must be replaced from time to time, eventually the ties themselves must be replaced, since the repeated hammering of spikes into the ties destroys their usefulness.

Similarly, The Bethlehem Steel Co. manufactures a switch point guard rail, for example the model 755, in which the rail is bolted to a plate which rests on the rail bed.

However, as the guard rail wears, it must, of course, be replaced.

In accordance with this invention, a switch point guard rail system is provided in which a guard rail, after wear in use over a period of time, may be advanced into a second position for further use, rather than being replaced. Accordingly, the need for replacement guard rails is substantially cut over the normal replacement rate in the prior art systems.

Furthermore, the guard rail of this invention is replaceable without having to pull spikes from a tie, and then redrive the spikes to install the new equipment. Also, the system of this invention is compact and simple to install, while providing the significant advantage of substantially extending the useful life of the guard rails.

DESCRIPTION OF THE INVENTION

In accordance with this invention a switch point guard for railroad track is provided, having a guard rail positioned to prevent flanges of railroad wheels from striking the switch point. The guard rail is carried on support members for rigid retention at a fixed, predetermined position relative to the track.

In accordance with this invention the guard rail is carried by horizontally positioned guard rail plates attached to the side of the guard rail. Apertures are defined in the guard rail plate means, and chock plates positioned in the apertures. The chock plates each define an aperture off center in the direction perpendicular to the guard rail.

The support members define attached projecting members occupying the off center apertures. As the result of this, peripheral edges of the chock plates, and particularly the edges parallel to the guard rail, occupy different positions depending upon which side of the chock plates faces toward the rail track, since the apertures in the chock plates through which the projecting members extend must occupy a constant position. Accordingly, the predetermined position of the guard rail can thus be varied, since it must be positioned in a manner relating to the positions of the parallel edges of the chock plates.

It is also preferred for each chock plate to be secured to a support member by the use of bolts at each end of the chock plate or the like.

Each support member also may include a support piece which abuts a rail of the railroad track with an edge which is profiled to mate with the side of the rail, to provide firm spacing between the track and the support member.

If desired, the support members may be directly secured to a rail of the railroad track by strap members bolted between adjacent support members and the rail of the railroad track. The bolt which is attached to the rail may project through an aperture in the rail into retentive relation with the strap member.

Also the strap member may comprise an elongated, rigid strap for bolting at opposite ends thereof to a pair of the support members. A laterally projecting member carried on the strap member is provided for receiving and retaining the bolt which projects through the aperture of the rail.

Referring to the drawings.

Figure 1:
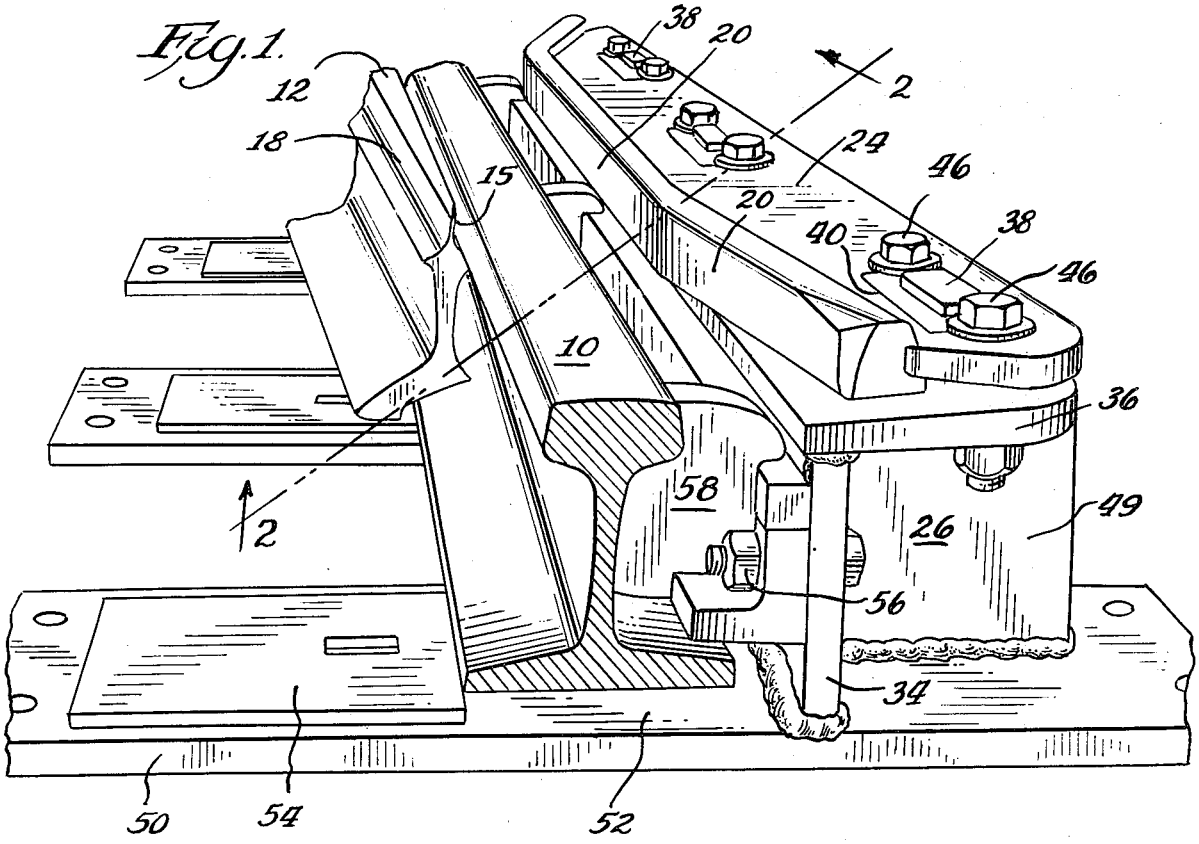
FIG. 1 is a perspective view of a section of a rail of railroad track, showing the guard rail of this invention.
Figure 2:
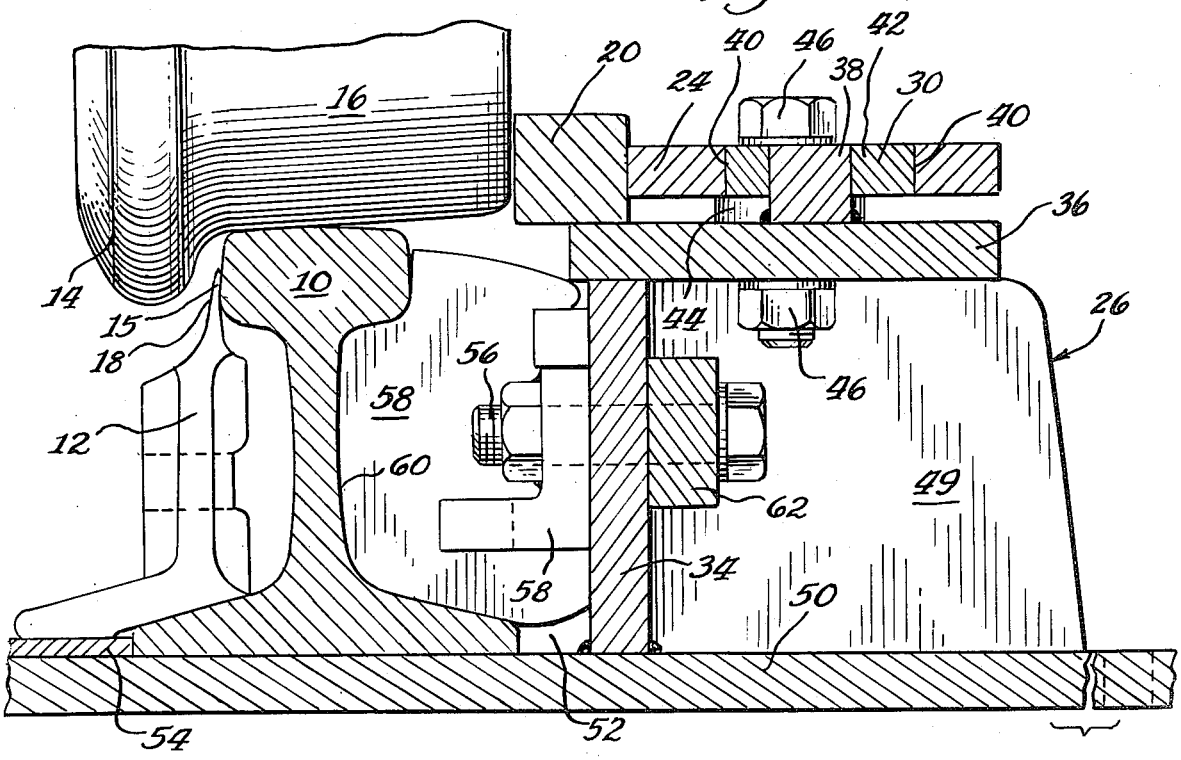
FIG. 2 is a transverse sectional view of the rail system of this invention, taken along line 2—2 of FIG. 1 and showing the chock plates in one position.

Referring to the drawings, a perspective view of a switch point is disclosed in FIG. 1. A rail 10 of conventional railroad track is joined by a switching rail 12, having a pointed end 15 as shown. When it is desired to make the switching connection, switching rail 12 as shown is brought into adjacent relation with rail 10. As indicated in FIG. 2, the flange 14 of a railroad wheel 16 engages the edge 18 of switching rail 12, causing the wheel to be removed from rail 10 onto rail 12 for the switching operation. When switching is not desired, rail 12 is moved to a position spaced from rail 10, so that the rail wheels continue to roll on rail 10.

Guard rail 20, as shown, is positioned to prevent flange 14 of the wheel from engaging the point 15 of switching rail 12. This prevents the damaging of point 15, which can result in the subsequent derailment of railroad cars at the switch.

In accordance with this invention, guard or deflector rail 20 is carried in rigid retention at a fixed, predetermined position relative to track rail 10 by horizontally positioned guard rail plate 24, attached by welding or the like to the side of guard rail 20, and carried by a plurality of support members 26, three being specifically shown in this present invention. Alternatively, guard rail plate 24 may comprise three separate plates, each being separately carried by a support member.

Apertures 28 are defined in the guard rail plates 24, with chock plates 30 filling each aperture 28. As shown herein, chock plates 30 each define an aperture 32 which is positioned off center in the chock plate in a direction perpendicular to guard rail 20.

Each support member 26 is shown to comprise a vertical upstanding wall 34 and a horizontal plate 36. Positioned on horizontal plate 36 (FIG. 4) is a projecting member 38 which is proportioned to fill the off-center aperture 32 of the associated chock plate 30 as shown. As the result of this, the peripheral edges 40 of the chock plates, and particularly the peripheral edges which are parallel to the central portion of the guard rail 20, occupy different positions depending upon which side of the chock plate faces toward the rail 10 and guard rail 20. For example, as shown in FIG. 2, chock plate 30 is positioned so that its wider side 42 is spaced away from guard rail 20. However, when the chock plates 30 are reversed, as in FIG. 5, then the wider side 42 is positioned on the same side as guard rail 20. In this latter instance, the guard rail arrangement must be assembled with guard rail 20 occupying a position closer to track rail 12 than in the position of FIG. 2.

Figure 5:
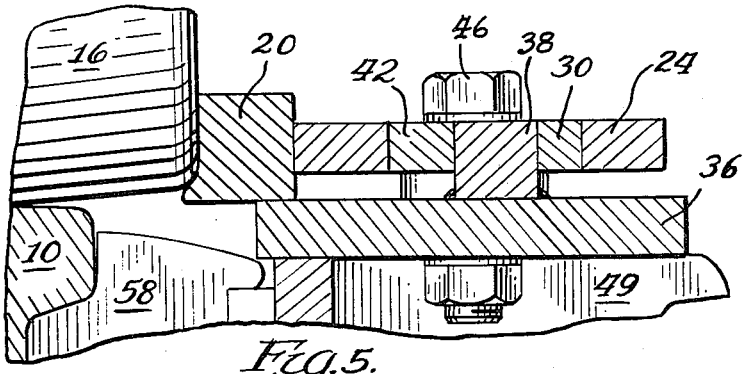
FIG. 5 is a transverse sectional view similar to FIG. 2, but showing the chock plates in its other position.
Figure 6:
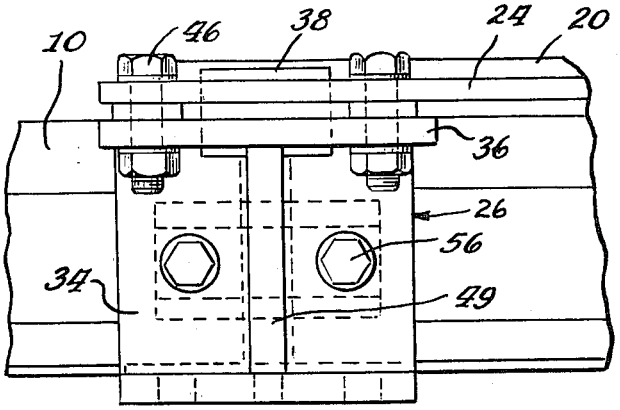
FIG. 6 is a fragmentary elevational view of the system of this invention, taken at one end thereof.

Accordingly, guard rail 20 can occupy two rigid, predetermined positions. The initial position of the guard rail may be as shown in FIG. 2. Then, after considerable use and wear, when part of guard rail 20 has been worn away as shown in FIG. 5, and the flanges 14 of rail wheels 16 are getting dangerously close to the point 15 of switching rail 12, one may disassemble the guard rail system of this invention, reverse the chocks 30 to their other sides, and reassemble the system, with the result that guard rail 20 is advanced closer to rail 12. Thus, guard rail 20 can be used for another period of time despite its prior wear. The specific guard rails 20 disclosed herein have a useful life which can be approximately 66 percent longer than the guard rails of the prior art by advancing the guard rail by $\frac{1}{4}$ inch from their original position, after the guard rail has been worn away about $\frac{3}{8}$ inch.

Horizontal rail plate 24 may be positioned on a washer or spacer 44 which, in turn, rests upon horizontal plate 36. Bolts 46 pass through notches 48 of the cam plates 30 to cause retention of the cam plates and securance thereof to the support member 26.

Guard rail 20 may be made of a steel alloy having about 12 to 14 percent by weight of manganese, to maximize resistance to wear. Guard rail 20 may be welded to plate 24, which may be made of cheaper, manganese-free mild steel for purposes of economy.

Vertical plate member 49 is also provided to each support member, positioned in a manner perpendicular to vertical plate 34, with plates 34, 36, and 49 being welded together and, in turn, welded to base plate 50, which may rest upon the rail bed. Accordingly, a strong member is provided for support against the high stresses imparted to the system by rail wheels which must be held in outward position to avoid damaging the switch point 15. Track rail 10 may rest in a trough 52 defined between vertical plate 34 and trough-forming plate 54 which may be attached by bolting or welding to base plate 50.

Each support member 26 may carry a support piece 58 by bolts 56 or the like passing through vertical plate 34. As shown, support piece 58 abuts track rail 10 with an edge 60 which is profiled to mate with the side of rail 10. This provides firm, reliable spacing and positioning between the track rail 10 and the guard rail 20.

Spacer member 62 for bolt 56 may be provided if desired.

Figure 3:
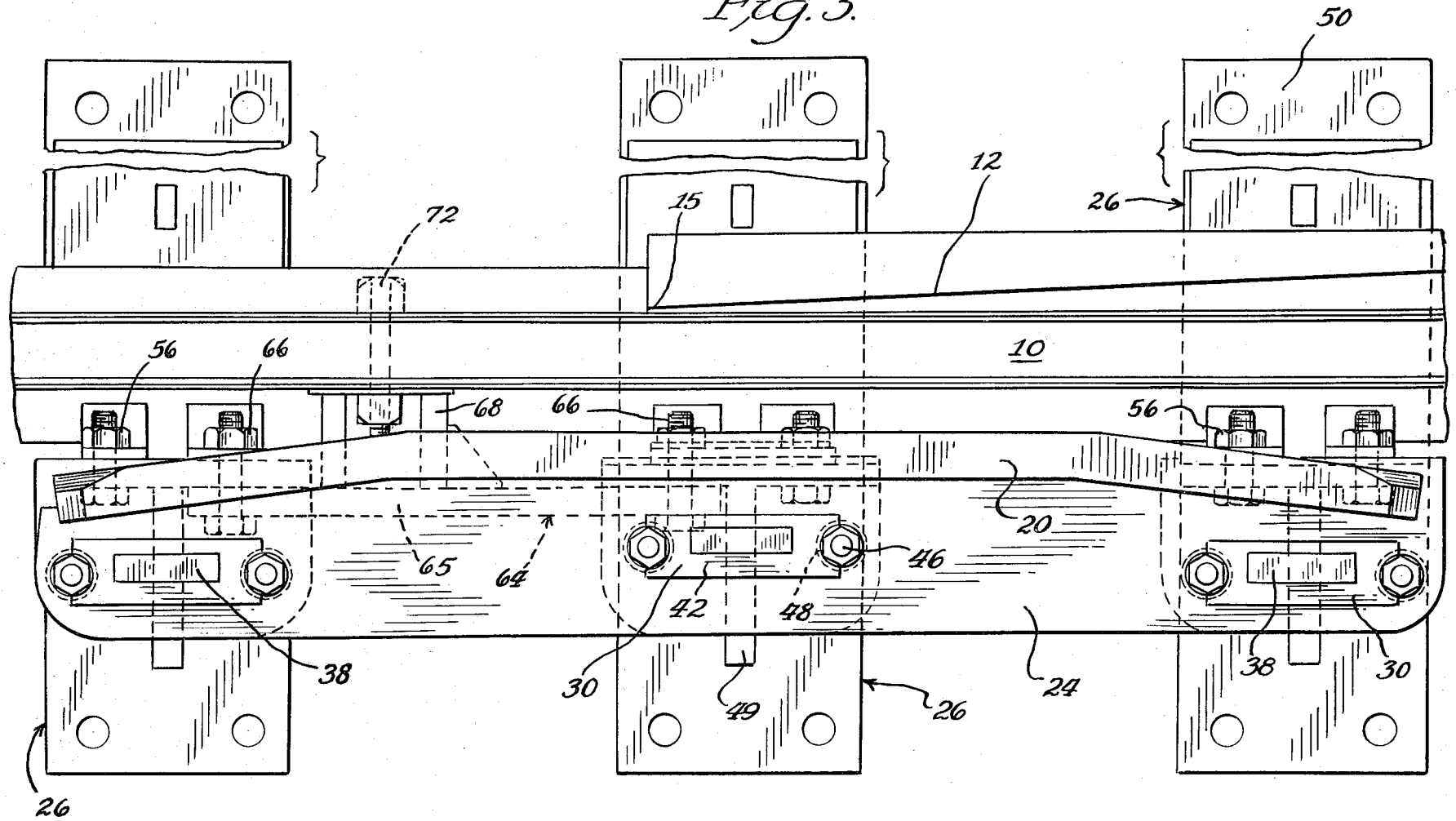
FIG. 3 is a plan view of the rail system of this invention.
Figure 4:
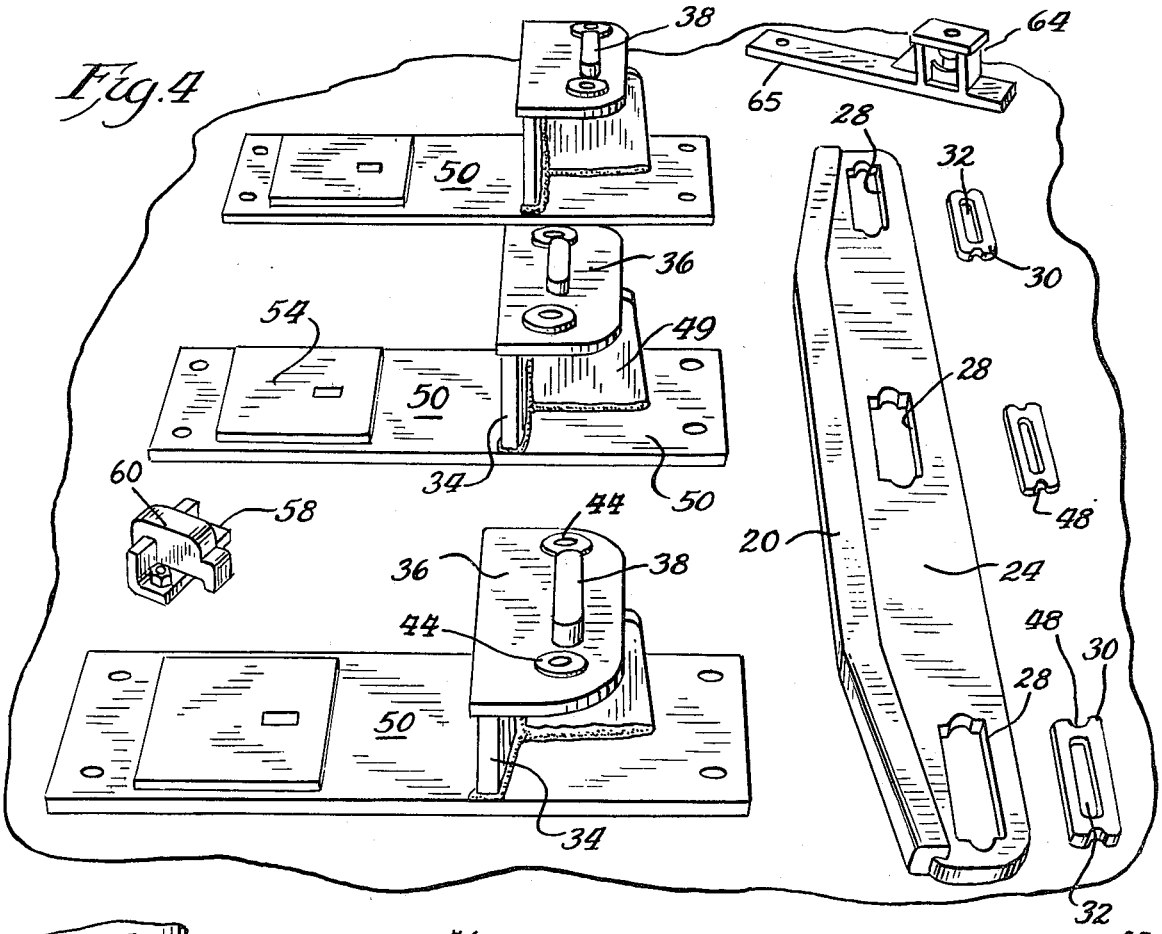
FIG. 4 is an exploded perspective view of the rail system of this invention, with certain parts omitted for clarity of disclosure.
Figure 7:
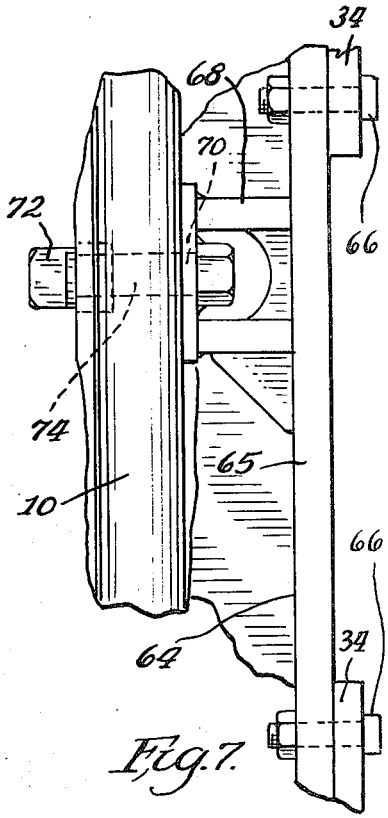
FIG. 7 is a detailed plan view of an optional structure of this invention, showing the operation of the strap member to retain the rail and the support members together.

Referring to FIGS. 3, 4 and 7, optional strap member 64 is shown, comprising an elongated, rigid strap 65 attached to separate vertical plates 34 of adjacent support members by bolts 66.

A laterally projecting member 68 is carried on strap 65 and has an aperture 70 for receiving a bolt 72, which bolt projects through an aperture 74 in track rail 10 for securance of strap member 64 thereto. Thus, for added strength of the system, the respective support members may be bolted to their adjacent track rail.

The resulting switch point guard system provides reliable, long-term service, plus increased wear time for substantial cost savings during operation.

The above has been offered for illustrative purposes only, and is not intended to limit the scope of the invention of this application, which is as set forth in the claims below.

That which is claimed is:

1. In a switch point guard for railroad track, having a guard rail positioned to prevent flanges of railroad wheels from striking the switch point, said guard rail being carried on support members for rigid retention at a fixed, predetermined position relative to the track, the improvement comprising, in combination:

said guard rail being carried by horizontally positioned guard rail plate means attached to the side of said guard rail, apertures defined in said rail plate means, reversible chock plate means positioned in said apertures, said chock plate means defining an aperture off center in the direction perpendicular to said guard rail, said support members defining attached projecting members occupying said off center apertures, whereby peripheral edges of said chock plate means occupy different positions depending upon which side thereof faces toward said track, and the predetermined position of said deflector rail can accordingly be varied.

2. The switch point guard of claim 1 in which each chock plate is secured to a support member.

3. The switch point guard of claim 1 in which each support member includes a support piece which abuts a rail of the railroad track with an edge profiled to mate with the side of said rail.

4. The switch point guard of claim 1 in which said guard rail is made of manganese steel alloy, said guard rail plate means being made of mild steel.

5. The switch point guard of claim 1 in which said support members are directly secured to a rail of said railroad track by strap member means bolted between said support members and said rail of the railroad track, the bolt attached to said rail projecting through an aperture in said rail.

6. The switch point guard of claim 5 in which said strap member comprises an elongated, rigid strap for bolting at opposite ends thereof to a pair of support members, and a laterally projecting member carried on said strap member for receiving and retaining said bolt projecting through said aperture of the rail.

7. In a switch point guard for railroad track having a guard rail positioned to prevent flanges and railroad wheels from striking the switch point, said guard rail being carried on support members for rigid retention at a fixed, predetermined position relative to the track, the improvement comprising, in combination:

said guard rail being carried by horizontally positioned guard rail plate means attached to the side of said guard rail, apertures defined in said rail plate means, reversible chock plate means positioned in said apertures, said chock plate means defining an aperture off center in the direction perpendicular to said guard rail, said support members defining attached projecting members occupying said off center apertures, whereby peripheral edges of said chock plate occupy different positions depending upon which side thereof faces toward said track, and the predetermined position of said guard rail can accordingly be varied, each support member including a support piece which abuts a rail of the railroad track with an edge profiled to mate with the side of said rail, and in which said support members are directly secured to a rail of said railroad track by strap member means bolted between said support members and said rail of the railroad track, the bolt attached to said rail projecting through an aperture in said rail.

8. The switch point guard of claim 7 in which said strap comprises an elongated, rigid strap for bolting at opposite ends thereof to a pair of support members and a laterally projecting member carried on said strap member for receiving and retaining said bolt projecting through said aperture of the rail.

9. The switch point guard of claim 8 in which each chock plate is secured to a support member.

10. The switch point guard of claim 9 in which said guard rail is made of manganese steel alloy, said guard rail plate means being made of mild steel.

* * * * *